United States Patent [19]
Hasegawa et al.
[11] Patent Number: 5,035,278
[45] Date of Patent: * Jul. 30, 1991

[54] APPARATUS FOR CONTINUOUS CASTING OF METAL STRIP

[75] Inventors: Morihiro Hasegawa; Takashi Yamauchi, both of Yamaguchi, Japan

[73] Assignee: R. J. Reynolds Tobacco Company, Winston-Salem, N.C.

[ * ] Notice: The portion of the term of this patent subsequent to Mar. 14, 2006 has been disclaimed.

[21] Appl. No.: 416,322

[22] Filed: Oct. 2, 1989

[30] Foreign Application Priority Data

Oct. 7, 1988 [JP] Japan ..... 63-251966

[51] Int. Cl.[5] ..... B22D 11/06
[52] U.S. Cl. ..... 164/428; 164/480
[58] Field of Search ..... 164/428, 480

[56] References Cited

U.S. PATENT DOCUMENTS 4,811,780 3/1989 Yamauchi et al. ..... 164/428

FOREIGN PATENT DOCUMENTS 59-215255 12/1984 Japan ..... 164/480
63-36955 2/1988 Japan ..... 164/428
63-126650 5/1988 Japan ..... 164/428

*Primary Examiner*—Kuang Y. Lin

[57] ABSTRACT

A twin roll continuous casting apparatus for continuously casting a metal strip through a gap of a pair of internally cooled rolls rotating in the opposite direction to each other having a pair of abradable side dams disposed on both sides of the rolls wherein a vessel for a pool of molten metals provided, at least a portion of the bottom or sides of the vessel slidably contacting the circumferential surface of the lower roll.

4 Claims, 3 Drawing Sheets

APPARATUS FOR CONTINUOUS CASTING OF METAL STRIP

TECHNICAL FIELD OF THE INVENTION

The present invention relates to an improvement in a twin roll continuous casting apparatus for continuously casting a metal strip directly from a molten metal such as a molten steel.

BACKGROUND OF THE INVENTION

Well known in the art is a so-called twin roll continuous casting apparatus in which a pair of internally cooled rolls having respectively horizontal axes and rotating in opposite direction to each other are disposed parallel to each other with an appropriate gap therebetween, a pool of molten metal is formed on the circumferential surfaces (the upper halves cylindrical surfaces in the axial directions) of the rolls above the gap and the molten metal is continuously cast into a metal strip through the gap while being cooled by the circumferential surfaces of the rotating rolls. There has also been proposed such a twin roll continuous apparatus applied to a case of continuous casting of steel to produce a steel strip directly from molten steel.

When a metal strip is continuosly cast through a gap between a pair of rolls, it is necessary to form a pool of molten metal on the circumferential surfaces of the pair of rolls above the gap therebetween and to maintain a level of the molten metal in the pool substantially constant by continuously pouring the molten metal into the pool. In order to form the pool of molten metal, there are required a pair of dams having their surfaces perpendicular to the roll axes which prevent an overflow of molten metal along the roll axes on the circumferential surfaces of the rolls. These dams also serve usually to regulate the width of the cast strip and are referred to herein as "side dams". In addition to the side dams disposed at the left and right sides of the rolls, a pair of front and rear dams (which may be referred to as "longitudinal dams") having their surfaces along the roll axes may be erected orthogonally to the side dams on the circumferential surfaces of the rolls so as to form a box-like pool for molten metal with the side dams and the front and rear dams.

There are known, as the pair of side dams, movable side dams which urge a pair of endless metal belts, caterpillars and the like against both edge surfaces of the rolls (side surfaces of the rolls perpendicular to the roll axes) at a location of the roll gap and move at a speed corresponding to the casting speed. With such movable side dams, however, the constitution of the apparatus becomes complicated. Also known in the art are fixed side dams which have plate-like bodies of refractories fixed to left and right side surfaces of the rolls. Since the fixed side dams undergo a great deal of friction with the rotating rolls and the ends of the strip being cast, they are generally made of heat resistant refractory materials having high strength. Never-the-less, damages of the fixed side dams are not completely avoided, may be a cause of leakage of molten metal and may invite cracks at the ends of the strip.

In Japanese Patent Application No. 62-84,555 (published as JP A-63-252,646, corresponding to U.S. Pat. No. 4,811,780), we have proposed a continuous casting apparatus for metal strip which may be said "abradable dam system" or "semi-movable dam system" intermediate between "movable" and "fixed" dam systems. According to our prior proposal, a refractory material capable of being well abraded is used as the material for the side dams, contrary to the prior art concept that refractory materials suitable for the side dams should have a good wear resistance and the highest possible strength. The abradable side dams are forcibly fed or moved in the casting direction during the casting while being frictionally abraded by slidably contacting surfaces of the rotating rolls and ends of the strip being cast. By this abradable dam system, the problems associated with the twin roll continuous casting apparatus, of molten metal leakage in the vicinity of the side dams, damages of the side dams and cracks of the ends of the cast strip are overcome, whereby the production of metal strips of a good quality may be stably carried out.

OBJECT OF THE INVENTION

An object of the invention is to provide a further improvement in the continuous casting apparatus of the abradable dam system which we have previously proposed in Japanese Patent Application No. 62-84,555, which improvement comprising enlarging the volume of the molten metal pool formed on the circumferential surfaces of the rolls to broaden the area of the surface of molten metal, thereby facilitating the maintenance of molten metal in the pool at a predetermined level and thus ensuring capability of producing metal strips of high quality more advantageously from the stand point of operating the apparatus.

SUMMARY OF THE INVENTION

An apparatus for continuously casting a metal strip according to the invention comprises:

a pair of internally cooled upper and lower rolls rotating in the opposite direction to each other and disposed parallel to each other at different levels with their axes held horizontal, the circumferential surface of said lower roll being below the circumferential surface of said upper roll;

a vessel for a pool of molten metal, at least a portion of the bottom or sides of said vessel slidably contacting the circumferential surface of said lower roll;

a pair of side dams disposed perpendicular to the axes of the rolls with a space therebetween approximately corresponding to the width of a metal strip to be cast and so that at least a portion of the thickness of each dam may slidably contact the circumferential surfaces of the rolls, at least those portions of said side dams which come in slidable contact with the circumferential surfaces of the rolls being composed of a refractory material capable of being well abraded; and mechanisms for forcibly feeding said side dams in the casting direction at a predetermined speed, thereby continuously casting molten metal into a metal strip through a gap between the pair of rolls while pressing said side dams against the rolls by said mechanisms and abrasively wearing said side dams with the circumferential surfaces of the rotating rolls.

Thus, the apparatus for continuously casting a metal strip according to the invention is characterized in that for a purpose of enlarging the volume and the surface area of molten metal in the pool in a twin roll continuous casting apparatus, rolls are disposed at different levels, and a vessel for the pool of molten metal is connected to the circumferential surface of the lower roll; and that to such a twin roll continuous casting apparatus having a separate vessel for the pool of molten metal is applied an abradable dam system as proposed in Japanese Patent Application No. 62-84,555. In the apparatus according to the invention, the bottom or sides of the vessel may be composed of a refractory material capable of being well abraded, and there may be provided a mechanism for feeding the vessel at a predetermined speed so that those abradable portions of the vessel may be abrasively worn by the circumferential surfaces of the rotating rolls. Furthermore, in the apparatus according to the invention, means for inwardly pressing the side dams may be provided whereby inside surfaces of the side dams may be abraded at those portions which slidably contact side walls of the vessel for a pool of molten metal.

EMBODIMENTS OF THE INVENTION

The invention will now be described in detail with reference to the drawings.

Figure 1:
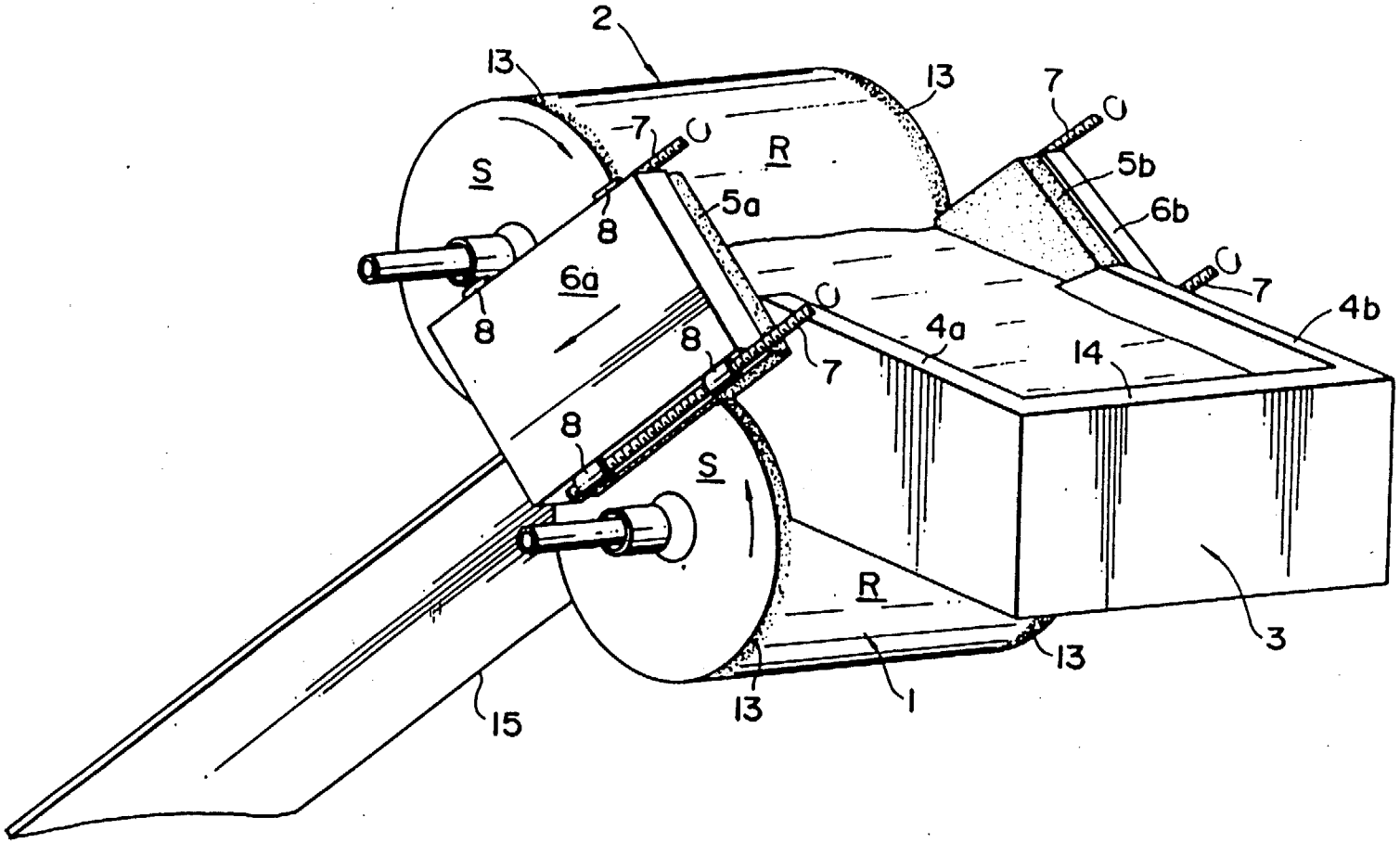
FIG. 1 is a perspective view showing principal portions of an embodiment of the apparatus according to the invention.

FIG. 1 depicts principal portions of an embodiment of the apparatus according to the invention under the condition of stationary working. Referring to FIG. 1, reference numerals 1 and 2 designate a pair of internally cooled rolls rotating in the opposite direction to each other (the rotational directions of both rolls are shown by arrows) and opposed parallel to each other with their roll axes held horizontal. They are disposed at different levels so that the circumferential surface of one roll 1 is below the circumferential surface of the other roll 2. The rolls 1 and 2 are referred to herein as the lower and upper rolls, respectively. While the lower roll 1 and the upper roll 2 have the same diameter in the illustrated embodiment, they may have different diameters provided that a plane including the axes of both the rolls is inclined by an angle of more than 0° and less than 90° from a horizontal plane. In the illustrated embodiment the rolls 1 and 2 are internally cooled with water. More specifically, the rolls 1 and 2 are formed on the inside of roll sleeves constituting the circumferential surfaces R with groove-shaped cooling water paths (not shown). The circumferential surfaces R are adapted to be cooled to a predetermined temperature by water passing through the cooling water paths. Cooling water is supplied to and drained from the cooling water paths on the inside of the circumferential surface R through a shaft of each roll, which is of a double pipe structure.

A reference numeral 3 designates a vessel for a pool of molten metal. The vessel 3 has one side wall cut away and is disposed so that the portion of the cut-away side wall (the bottom wall and remaining side walls 4a, 4b adjacent to the cut-away side wall) may slidably contact the circumferential surfaces of the lower roll 1. In the embodiment shown in FIG. 1, side dams 5a, 5b are disposed so that portions of inside surfaces of the side dams 5a, 5b may slidably contact the outside surfaces of the side walls 4a, 4b of the vessel 3, respectively.

The side dams 5a, 5b are made of an abradable refractory material and, in the illustrated embodiment, they are disposed so that a portion (inner portion) of the thickness of each side dam may be positioned on the roll sleeve, that is, a portion of the bottom of each side dam may slidably contact the circumferential surfaces of the rolls, and the remaining portion (outer portion) of the thickness of each side dam may extend outwards beyond the ends of the rolls with an inside surface of the extending portion of the side dam in slidable contact with the side surfaces S of the rolls. There are provided mechanims for feeding the side dams 5a, 5b in the casting direction while keeping the above-mentioned disposition of the side dams.

In the illustrated embodiment, the mechanisms for feeding the side dams 5a, 5b in the casting direction include supporting plates 6a, 6b for fixedly supporting the side dams 5a, 5b from the outside surfaces thereof. Each of the plates 6a, 6b is supported by a plurality of struts 7 with screws through nuts 8 fixed to the plate side. The struts 7 are disposed in the casting direction. While a plurality of struts are illustrated, a structure of a single strut is also possible. Each strut 7 is rotated about its own axis to move the supporting plates 6a, 6b in the casting direction. Thus, the side dams 5a, 5b during the running of the apparatus are forcibly fed in the casting direction.

Figure 2:
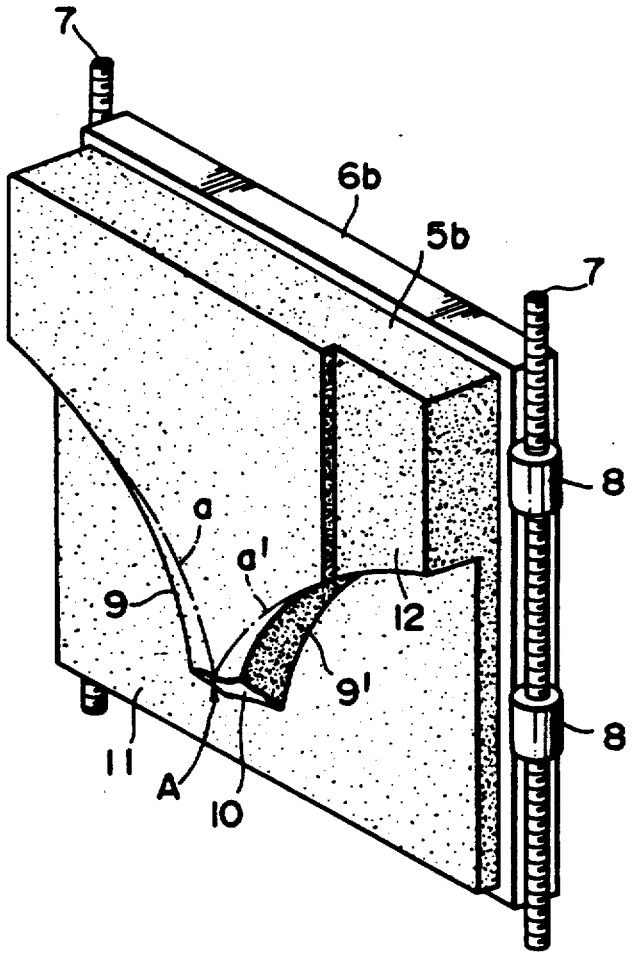
FIG. 2 is a perspective view of the side dam in the apparatus of FIG. 1 under the condition where the degree of abrasion of the dam is proceeded in the casting process.

FIG. 2 shows the internal surface condition of the side dam during the running of the apparatus. While the side dam 5b is shown in the figure, the same condition appears on the other side dam 5a. As shown in FIG. 2, the side dam 5b has in its inner thickness portion bottom surfaces 9, 9' worked to have curved surfaces corresponding to the circumferential shapes of the rolls 1, 2. The central lower end 10 of the bottom surfaces 9, 9' abuts on the side edge of the strip being cast and abraded. Curves a, a' show interface levels between molten metal and thin shells solidified from the molten metal on the circumferential surfaces of the rolls. The solidified shells formed on the surfaces of the respective rolls grow and combine together at point A along with the rotation of the rolls, and the combined shells are rolled through the gap between the rolls. By this rolling the strip is expanded widthwise and the side edges of the expanded strip abrade the lower end 10 of the side dam. The extent of the abrasion of the lower end 10 varies depending upon the thickness of the strip being cast, the casting speed and other casting conditions, and might go beyond the width of the bottom surfaces 9, 9', that is, the thickness of the side wall existing on the circumferential surfaces of the rolls. The expanding strip edge will be checked by a back up surface 11 around the bottom surfaces 9, 9' and the lower end 10 which slidably contacts the side surfaces S (FIG. 1) of the rolls and had sufficient area and thickness, whereby risk of molten metal leakage will be avoided.

In order that the bottom surfaces 9, 9' of the side dams 5a, 5b may be effectively abraded by the circumferential surfaces of the rolls, those portions of the circumferential surfaces of the rolls slidably contacting the side dams 5a, 5b are preferably formed into rough surfaces 13 (FIG. 1) having an abrading ability.

In the running of the apparatus according to the invention, outside surfaces of the side walls 4a, 4b of the vessel 3 slidably contacts portions (shown by a reference numeral 12 in FIG. 2) of inside surfaces of the side dams 5a, 5b. In order that the side dams are abraded at those portions, it is preferred to provide means for inwardly pressing the side dams. By such means sealing of the slidable contact parts can be maintained in good condition.

Materials constituting the side dams should be not only adiabatic but also abradable. Examples of such suitable materials include, for example, adiabatic bricks, ceramic fiber boards and boron nitride (BN) which have good abradability, that is, an ability of capable of being well abraded. The side dams may be wholly made of such abradable materials, or only those portions which are to be abraded may be made of such materials. Further, those portions of the vessel 3 which come in slidable contact with the circumferential surfaces of the rolls may be composed of similar abradable refractory materials, and there may be provided a mechanism for feeding the vessel at a predetermined speed so that those abradable portions of the vessel may be abrasively worn by the circumferential surfaces of the rotating rolls.

While the rough surfaces 13 formed on the circumferential surfaces of the rolls may be have roughness and hardness suitably selected depending upon the materials and feed rates of the side dams and vessel, they normally comprise a roughened layer of a hard material such as hard metals, ceramics and cermets. The abrading rough surface may be formed on the circumferential surfaces of the rolls preferably by plating of hard metals of by flame spraying of hard metals, ceramics or cermets. Suitable hard metals for plating include Ni and Ni-based alloys, Ni—Fe alloys, Cr and Cr-based alloys, and Fe alloys. Suitable metals for flame spraying include Ni—Cr alloys, carbon steels and stainless steels; suitable ceramics for flame spraying include $Cr_2O_3$, $TiO_2$, $Al_2O_3$ and $ZrO_2$, and suitable cermets for flame spraying include $ZrO_2$—NiCr, $Cr_3C_2$—NiCr and WC—Co.

Figure 3:
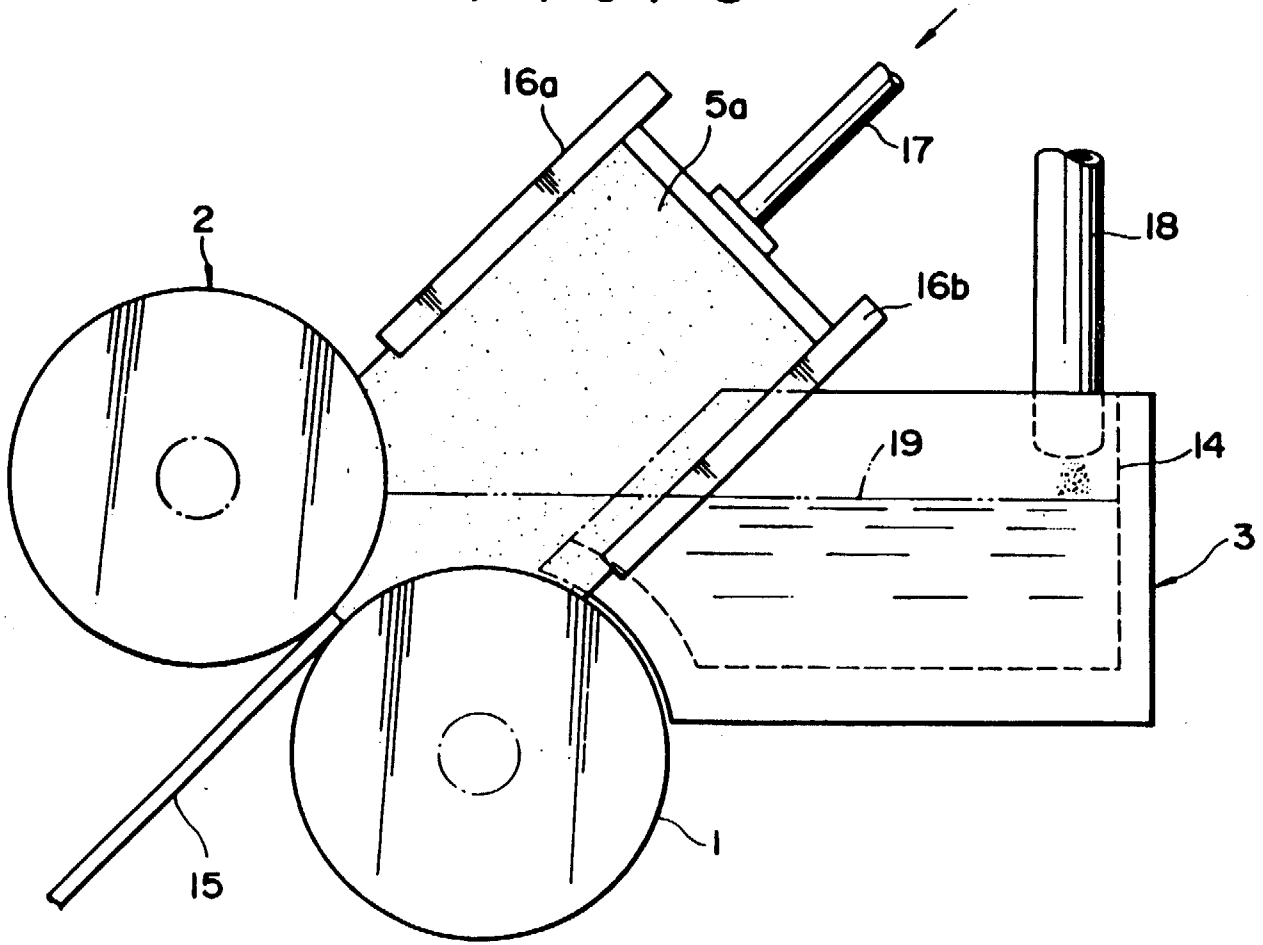
FIG. 3 is a schematic vertical cross-sectional side view of another embodiment of the apparatus according to the invention.

While heretofore has been described an example of the side dams 5a, 5b having portions of the thickness on the circumferential surfaces of the rolls, the invention may also be applied to a system in which the whole thickness of the side dams comes on the roll surfaces FIG. 3 shows this example. Since FIG. 3 is a side view, the side dam 5a is only seen. The side dam 5b not seen in the figure has the same constitution as the side dam 5a. In this example, the side dams are disposed on side edge portions of the rolls with the whole thickness the bottom surfaces positioned on the circumferential surfaces of the rolls. Positioning of each side dam is made by guide frames 16a, 16b holding and guiding the dam from both sides. Namely, the side dam 5a is disposed so that it may be caused to slide in the casting direction along the fixed mounted guide frames 16a, 16b by means of a feeding mechanism comprising a feeding rod 17 and a power device (not shown). In FIG. 3, a reference numeral 18 designates a nozzle for pouring molten metal into the vessel 3 for a pool of molten metal; and 19 a level of molten metal in the vessel 3. The vessel 3 is disposed so that portions of the outside surfaces of its side walls may slidably contact portions of inside surfaces of the side dams, as is the case with the apparatus shown in FIG. 1.

EFFECT OF THE INVENTION

In the apparatus according to the invention, the advantages of the abradable dam system are fully utilized and since a broad molten metal surface can be formed by providing the vessel for a pool of molten metal, variations in the molten metal level can be minimized. Furthermore, by pouring molten metal into the vessel near the wall of the vessel remostest from the rolls, any influences of ripples and other local flow of molten metal upon pouring may be absorbed until they reach the circumferential surface of the upper roll 2, and thus, sound solidified shells are formed on the surfaces of the rolls, leading to the production of strips (shown by a reference numeral 15 in the drawings) of good quality.

We claim:

1. An apparatus for continuously casting a metal strip comprising:

a pair of internally cooled upper and lower rolls rotating in the opposite direction to each other and disposed parallel to each other at different levels with their axes held horizontal, the lower roll being below the upper roll;

a vessel for a pool of molten metal, at least a portion of the bottom or sides of said vessel slidably contacting the circumferential surface of said lower roll;

a pair of side dams disposed perpendicular to the axes of the rolls with a space therebetween approximately corresponding to the width of a metal strip to be cast so that at least a portion of the thickness of each dam may slidably contact the circumferential surfaces of the rolls, at least those portions of said side dams which come in slidable contact with the circumferential surfaces of the rolls being composed of a refractory material capable of being well abraded; and mechanisms for forcibly feeding said side dams in the casting direction at a predetermined speed, thereby continuously casting molten metal into a metal strip through a gap between the pair of rolls while pressing said side dams against the rolls by said mechanisms and abrasively wearing said side dams with the circumferential surfaces of the rotating rolls.

2. The apparatus for continuously casting a metal strip according to claim 1 wherein those portions of the circumferential surfaces of the rolls slidably contacting the side dams are formed into rough surfaces having an abrading ability.

3. The apparatus for continuously casting a metal strip according to claim 1 or 2 wherein those portions of the bottom or sides of said vessel slidably contacting the circumferential surface of said lower roll are composed of a refractory material capable of being well abraded, and there is provided a mechanism for feeding said vessel at a predetermined speed so that those abradable portions of said vessel may be abrasively worn by the circumferential surfaces of the rotating rolls.

4. The apparatus for continuously casting a metal strip according to claim 1, 2 or 3 wherein means for inwardly pressing said side dams are provided whereby inside surfaces of said side dams are abraded at those portions which slidably contact side walls of said vessel for a pool of molten metal.

* * * * *

UNITED STATES PATENT AND TRADEMARK OFFICE

CERTIFICATE OF CORRECTION

PATENT NO. : 5,035,278

DATED : July 30, 1991

INVENTOR(S) : Morihiro Hasegawa et al

It is certified that error appears in the above-identified patent and that said Letters Patent is hereby corrected as shown below:

ON THE TITLE PAGE:

[73] Should read as follows:
Assignee: NISSHIN STEEL COMPANY, LTD.
Tokyo, Japan

Signed and Sealed this
Tenth Day of August, 1993

*Attest:*

Michael K. Kirk

MICHAEL K. KIRK

*Attesting Officer*

*Acting Commissioner of Patents and Trademarks*